United States Patent [19]

Mitchell et al.

[11] Patent Number: 4,844,460

[45] Date of Patent: Jul. 4, 1989

[54] METHOD OF FABRICATING A BALL-STRIKING IMPLEMENT

[75] Inventors: Hal D. Mitchell; Roger J. Lueckenhoff, both of Rolla, Mo.

[73] Assignee: Figgie International Inc., Willoughby, Ohio

[21] Appl. No.: 113,534

[22] Filed: Oct. 26, 1987

Related U.S. Application Data

[62] Division of Ser. No. 793,164, Oct. 31, 1985, abandoned.

[51] Int. Cl.[4] ..... A63B 59/06

[52] U.S. Cl. ..... 273/72 R; 273/67 R; 144/363; 144/346

[58] Field of Search ..... 273/72 R, 82 R; 144/355, 360, 346, 363

[56] References Cited

U.S. PATENT DOCUMENTS

| | | | |
|---|---|---|---|
| 727,359 | 5/1903 | Held | 273/72 R |
| 1,197,649 | 9/1916 | Miller | 273/82 R |
| 2,729,450 | 1/1956 | Clapham | 273/82 R |
| 3,598,410 | 8/1971 | Costopoulos | 273/72 R |

FOREIGN PATENT DOCUMENTS

| | | | |
|---|---|---|---|
| 17196 | 7/1906 | United Kingdom | 273/67 A |

*Primary Examiner*—Richard C. Pinkham
*Assistant Examiner*—Gary Jackson
*Attorney, Agent, or Firm*—Senniger, Powers, Leavitt and Roedel

[57] ABSTRACT

A method for fabricating a bat for striking a ball. The bat has a tapered barrel and a tapered handle and is formed of at least two pieces. Each piece, in its barrel, has a recess formed in it of a length less than the length of the barrel and which is formed along a surface which will be in the interior of the bat. The recesses combine to form a void which is of such a volume that the bat will have a desired weight and which is positioned along the longitudinal axis of the bat so that the bat will have a desired center of gravity. The bat is constructed by weighing the separate pieces, determining the proper location along each piece where material is to be removed to form the recesses and to determine how much material is to be removed, removing the material and then assembling the pieces to form the bat.

4 Claims, 1 Drawing Sheet

METHOD OF FABRICATING A BALL-STRIKING IMPLEMENT

This is a division of application Ser. No. 793164, filed Oct. 31, 1985, now abandoned.

BACKGROUND OF THE INVENTION

The present invention relates to a method of fabricating ball-striking implements, and more particularly, to a bat which has a desired weight and balance and is formed of a laminated structure.

Ball-striking implements such as baseball and softball bats, cricket bats, billiard cues and golf clubs have commonly been made of wood, although in recent years other materials such as aluminum, steel and plastic have been substituted because of scarcity of appropriate types of woods, cost and strength, as well as other factors. Experience has shown, particularly with such striking implements as baseball bats, that not only are particular types of woods more desirable, but that the manner in which a tree has grown affects its desirability for use in making a bat. Northern White Ash trees, for example, have been especially suited for making bats, particularly those trees with large growth rings which grew during years of good balance between moisture and nutrients in the forests. However, continued cutting of the Northern White Ash tree has depleted the availability of suitable lumber to make high quality baseball bats.

Additionally, it is advantageous to be able to adjust the weight and center of gravity or "balance" of the bat to be more suited to a particular player's use. In the past, attempts to achieve this in wooden bats have not met with general acceptance and have proved to be unsatisfactory for a variety of reasons.

SUMMARY OF THE INVENTION

The present invention overcomes the above-identified problems by providing a bat for striking a ball, comprising a tapered barrel portion of circular cross-section for striking the ball, a tapered handle portion of circular cross-section for gripping the bat, the bat being formed of at least two pieces joined longitudinally of the bat, each of the pieces having a portion forming the tapered barrel portion of the bat and having at least one void formed therein of a length less than the length of the barrel portion and disposed along a surface thereof which will lie adjacent the central longitudinal axis of the bat, the void being confined within the terminal end of the barrel portion and being of such a volume that the bat will have a predetermined weight and so positioned along the longitudinal axis of the bat that the center of gravity of the bat is disposed at a predetermined location.

In the method of the present invention, a bat of the above type is fabricated by forming a plurality of elongate pieces such that more than one piece is needed to form the bat, forming a void in each piece of a length less than the length of the barrel portion and disposed along a surface thereof which will lie adjacent the central longitudinal axis of the bat, the void being confined within the terminal end of the barrel portion and being of such a volume that the bat will have a predetermined weight and so positioned along the longitudinal axis of the bat that the center of gravity of the bat is disposed at a predetermined location, and assemblying the pieces to form the bat.

Additionally, the method preferably includes forming the bat of four pieces, each forming a quadrant in the cross-section of the bat, joining two of the four pieces together to form a first set and joining the other two pieces together to form a second set so that each set forms a half bat, placing the first set on a balance weigh scale, placing a plug of predetermined weight on the first set at a location which provides an indication by the scale of a desired weight and center of gravity of the first set which will produce the desired weight and center of gravity of the bat when assembled with the second set, marking the location of the plug on the first set and removing the plug from the first set, removing the first set from the scale, removing a volume of material from the first set to form the void at the location of the plug as marked thereon, the volume being sufficient that the weight of material removed is equal to the weight of the plug, performing the above steps on the second set, and joining the first and second sets together so that the voids are both internal to the bat. Other objects and features will be in part apparent and in part pointed out hereinafter.

DETAILED DESCRIPTION OF THE PREFERRED METHOD AND EMBODIMENT

Figure 1:
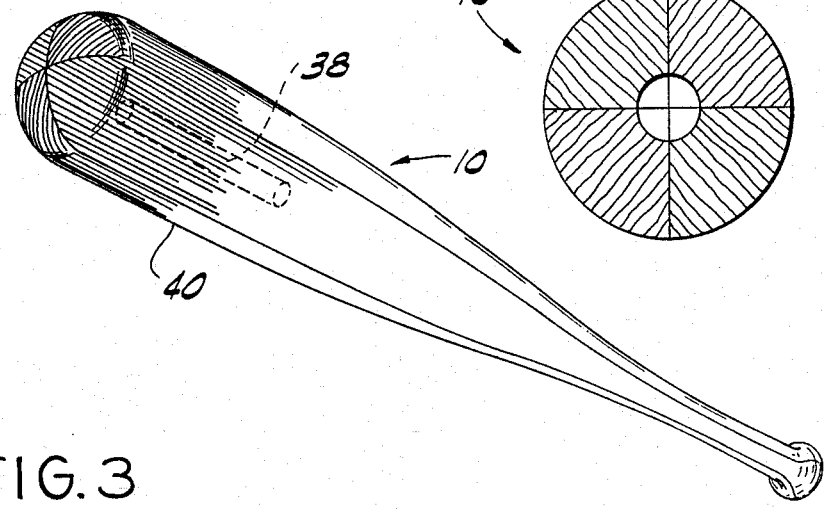
FIG. 1 is a perspective of a preferred embodiment of a baseball bat constructed in accordance with the present invention.
Figure 4:
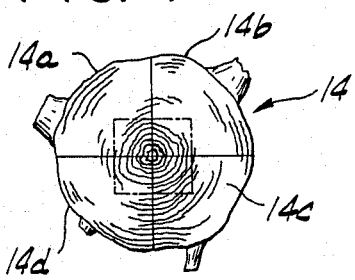
FIG. 4 is an end view of a log section showing the preferred cutting pattern to form the bat of FIG. 1.
Figure 5:
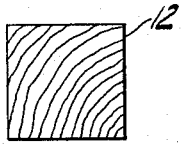
FIG. 5 is an end view of a wood billet.

The bat of the present invention is generally designated 10 and is shown in its completed form in FIG. 1. It is preferably made of a hard wood, and particularly one such as Northern White Ash. It is cut into billets 12 (FIG. 5) from a log 14 (FIG. 4), such as by cutting it into quarters 14*a–d*. The quarters are then formed into square cross-section billets or pieces 12 of approximately 1½ inches on a side.

Figure 6:
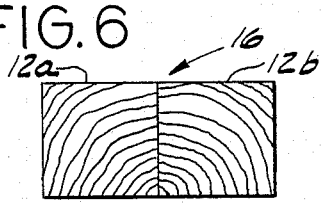
FIG. 6 is an end view of two wood billets joined together.
Figure 7:
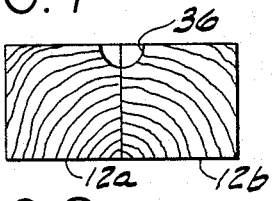
FIG. 7 is a transverse cross-sectional view of the two wood billets of FIG. 6, joined together and showing a void formed therein.
Figure 8:
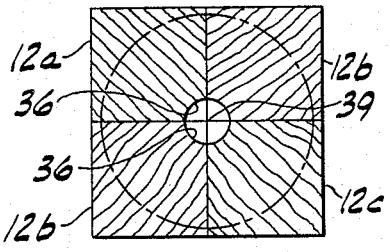
FIG. 8 is a transverse cross-sectional view of four wood billets joined together and having a void formed therein.

The billets 12 from several logs are then sorted by weight so that a selection of four billets of generally the same weight can be selected. Two of these billets (for example 12*a* and 12*b* as shown in FIG. 6) are then glued together to form a set 16 and two sets form the two halves of a bat 10. The grain of the wood of the billets is preferably aligned as shown in FIGS. 6–8, that is, with the grain of the wood extending generally in radial direction with respect to the longitudinal axis of the bat.

Each of the sets 16 is then weighed and balanced on a scale 20 designed to provide not only the weight of the set 16, but also to establish the center of gravity of the set and to provide a balancing point providing the desired properties of the bat 10, as indicated below. The scale 20 is generally of the type commonly used to establish the desired "balance" of golf clubs. In this particular case, however, the scale 20 has a balance point 22 and a support or pivot point 24 on the scale 20 on which the set 16 can pivot. A stop plate 26 is associated with the pivot point 24 to assist in positioning the set 16 on the scale 20.

The weight of each set 16 is determined by a weight sensor (not shown) of conventional construction, associated with the balance point 22, or the weight can be determined by placing the set on an entirely different scale, if desired. The scale 20 also has a readout 28 of unique information pertaining to the "balance" of the bat 10. This readout 28 can be fixed indicia 30 with a conventional pointer 32, as shown, or can be of different style, such as a digital readout with pre-established quantative values.

As shown, the readout 28 has only three values, A, B and C. Each of these values is pre-established through an empirical evaluation of desired bat "balance" or "feel", which is a subjective determination based upon the reaction of individuals with a variety of bat configurations. The number of values such as A, B and C may vary, with three being given merely as an example.

The values A, B and C relate to certain physical characteristics of bats 10. However, it must be remembered that the values A, B and C are adjusted to account for the fact that the object being evaluated on the scale 20 is a set 16, each formed by gluing together two pieces or billets 12, and not a complete bat 10. Each set 16 must yet be glued to another set and the two sets then shaped into a bat 10 as shown in FIG. 1. Therefore, the values A, B and C are adjusted to account for the difference between the set 16 actually being evaluated by the scale 20 and the final desired characteristics of the bat 10.

The weight of the bat 10 is one factor which is taken into account in evaluation of the set 16 on the scale 20. Another factor is the length of the bat. Yet another factor is the center of gravity of the bat. The "balance" or "feel" of the bat depends heavily on the mass distribution of material along the central axis of the bat. Although, presently, it is not known precisely how these factors interrelate to the effectiveness of the bat with a given person, these factors can be monitored to establish generally desirable characteristics for empirically established classes of people.

The "balance" or "feel" of a bat ultimately depends on the strength and speed of the individual using the bat. By classifying particular bat characteristics such as length, weight and center of gravity and comparing the subjective reactions as well as observed results of several individuals using a variety of bats, some emperical relationships can be observed. These relationships can then be separated into any desired number of groups, such as the groups A, B and C of the example, so that the particular attributes of a given bat design can be associated with a general class of users.

Figure 9:
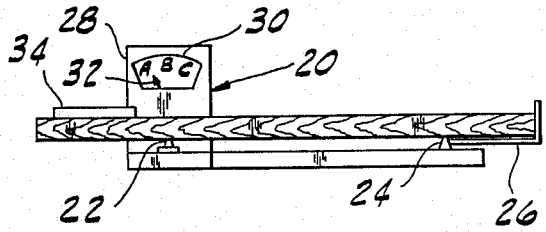
FIG. 9 is a diagrammatic view of a balance scale which can be used to determine the weight of the pieces from which the bat is formed and the location of the desired balance point of the bat.

Referring again to the scale 20 shown in FIG. 9, a set 16 will seldom be formed so that the scale pointer 32 points directly to a desired indicia A, B or C corresponding to a bat having the desired characteristics. Therefore, it is necessary to adjust the weight of the set as well as the distribution of the weight along the longitudinal axis of the set 16 and thus, ultimately, the bat 10. The actual weight of the set 16 is determined and then compared to the desired gross weight of a standard set associated with the indicia A, B or C. The difference is the amount of weight which must be removed from the set 16.

Not only must this weight be removed, but it must be removed from the proper location along the longitudinal axis of the set 16. To achieve this, the set is positioned on the scale 20, as shown, and a metal plug 34, equal in weight to the difference between the desired gross weight of the set 16 and the weight of a standard set, as mentioned above, is placed on the set 16 along its longitudinal axis. The plug is positioned at a location along this axis such that the pointer 32 points directly at the desired indicia A, B or C.

Again, it must be noted that indicia A, B and C are established on the basis of the ultimate desired characteristics of the bat 10. Thus, since the weight of the plug 34 on the bat will actually produce an undesirable location for removing weight to achieve desired bat weight, the indicia must be adjusted accordingly because there would otherwise be an inverse relationship between the actual location of the plug and the desired location of removal of material from the set. Thus, if this inverse relationship is taken into account when establishing the values of indicia A, B and C, the plug can actually be positioned on the set 16 at the actual location where material is to be removed.

When the plug 34 is properly positioned on the set 16 so that the pointer 32 points directly at the desired indicia A, B or C, its location along the longitudinal axis of the set 16 is marked and the set can then be removed from the scale 20. Then, material equal in weight to the weight of plug 34 is removed from the set 16 at the location marked. Removal of material can be accomplished, for example, by calculating the volume of wood which must be removed to correspond to the weight of the plug 34 and then a shaper or the like can be used to form a recess, as shown in FIG. 7, in one surface, constituting the interior surface, of the set 16 along its longitudinal axis. The recess is shown as semicircular in cross-section in FIG. 8 but this is not essential. Any shape of recess which can be easily formed can be used so long as it will not appreciably affect the strength of the bat.

Figure 2:
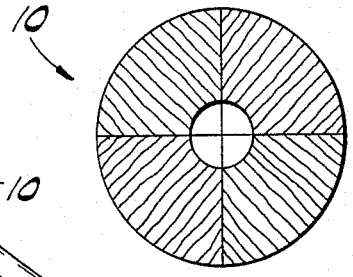
FIG. 2 is a transverse cross-section of the bat of FIG. 1 through the barrel portion of the bat and a void formed therein.
Figure 3:
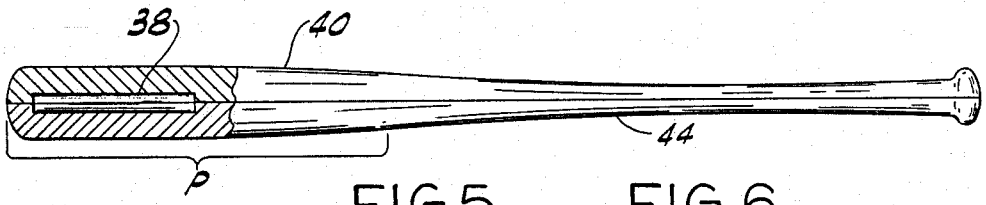
FIG. 3 is a side view of the bat of FIG. 1, partially broken away to show a void formed therein.

The same procedure is used for a second set 16 and then the two sets are joined, such as by gluing, with their interior surfaces flush against one another, as shown in FIG. 8. The resultant blank is then machined into the standard bat form as shown in FIGS. 1–3, with the cylindric void 38 formed from the two recesses 36 formed in each of the sets 16. The void 38 is disposed in the barrel 40 of the bat 10 and is of a length less than the length P of the barrel and along the longitudinal axis 39 of the bat 10 formed by the join lines of the billets 12. The void 38 is confined within the terminal end 42 of the barrel 40 and preferably at a distance E of approximately $1\frac{1}{2}$ inches from the barrel end of the bat so that it is not weakened. Likewise, the void 38 cannot extend into the handle 44 of the bat 10 since this might also weaken the bat. As a general guideline, the void should not be allowed to extend toward the handle 44 beyond the point on the bat where the diameter of the bat is less than about $2\frac{1}{4}$ inches.

When the bat 10 is constructed in the above manner it will have the desired characteristics which are easily repeatable in a number of bats. The void 38 is easily formed in this manner and is not visible from the outside of the bat and does not weaken the bat appreciably.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A method of fabricating a bat of the type used for hitting a game ball and having a tapered barrel of circular cross-section for striking the ball and a tapered handle of circular cross-section for gripping the bat, comprising:

forming first and second elongate members;

placing the first member on a balance weigh scale;

placing a plug of predetermined weight on the first member at a location which provides an indication by the scale of a desired weight and center of gravity of the first member which will produce the desired weight and center of gravity of the bat when assembled with the second member;

removing the plug from said location;

removing a volume of material from the first member to form a recess at said location, the volume being sufficient that the weight of material removed is equal to the weight of the plug;

performing the above steps on the second member; and joining the first and second member together to form the bat whereby the recesses combine to form a void internal to the bat.

2. A method of forming a bat of the type used for hitting a game ball and having a tapered barrel of circular cross-section for striking the ball and a tapered handle of circular cross-section for gripping the bat, comprising:

forming four elongate pieces, each piece being adapted to form a quadrant of the bat as it is viewed in a cross-section taken transversely of the bat;

joining two of the pieces together to form a first set and joining the other two pieces together to form a second set so that each set forms a half bat;

placing the first set on a balance weigh scale;

placing a plug of predetermined weight on the first set at a location which provides an indication by the scale of a desired weight and center of gravity of the first set which will produce the desired weight and center of gravity of the bat when assembled with the second set;

marking the location of the plug on the first set and removing the plug from the first set;

removing the first set from the scale;

removing a volume of material from the first set to form a recess at the location of the plug as marked thereon, the volume being sufficient that the weight of material removed is equal to the weight of the plug;

performing the above steps on the second set; and joining the first and second sets together so that the recesses combine to form a void internal to the bat.

3. A method of fabricating a bat of the type used for hitting a game ball and having a tapered barrel of generally circular cross-section for striking the ball and a tapered handle of generally circular cross-section for gripping the bat, comprising:

forming four elongated pieces of wood, each piece being of generally rectangular cross-section;

joining two of the pieces side-by-side to form a first set and joining a second two of the pieces side-by-side to form a second set;

placing the first set on a balance weigh scale;

placing a plug of predetermined weight on the first set at a location which provides an indication by the scale of a desired weight and center of gravity of the first set which will produce the desired weight and center of gravity of the bat when assembled with the second set;

marking the location of the plug on the first set and removing the plug from the first set;

removing the first set from the scale;

removing a volume of material from the first set to form a recess at the location of the plug as marked thereon, the volume being sufficient that the weight of material removed is equal to the weight of the plug;

performing the above steps on the second set;

joining the first and second sets together so that the recesses combine to form a void internal to the bat; and shaping the bat to have a barrel in the area of the void and a handle connected to the barrel, both the barrel and handle being generally circular in transverse cross-section.

4. A method as defined in claim 3 wherein the pieces are joined together by gluing.

* * * * *